US008153566B2

(12) United States Patent
Yamaguchi et al.

(10) Patent No.: US 8,153,566 B2
(45) **Date of Patent: *Apr. 10, 2012**

(54) LUBRICATING OIL COMPOSITIONS

(75) Inventors: Elaine S. Yamaguchi, Hercules, CA (US); Kam-Sik Ng, San Lorenzo, CA (US)

(73) Assignee: Cherron Oronite Company LLC, San Ramon, CA (US)

( * ) Notice: Subject to any disclaimer, the term of this patent is extended or adjusted under 35 U.S.C. 154(b) by 562 days.

This patent is subject to a terminal disclaimer.

(21) Appl. No.: 12/286,390

(22) Filed: Sep. 30, 2008

(65) Prior Publication Data

US 2010/0081588 A1 Apr. 1, 2010

(51) Int. Cl.
*C10F 7/04* (2006.01)
*C10M 139/02* (2006.01)
*C10M 159/22* (2006.01)

(52) U.S. Cl. ..... 508/202; 508/204; 508/460

(58) Field of Classification Search ..... 508/202, 508/204, 460

See application file for complete search history.

(56) References Cited

U.S. PATENT DOCUMENTS

| | | | |
|---|---|---|---|
| 2,416,504 | A | 2/1947 | Trautman et al. |
| 2,473,260 | A | 6/1949 | Rochow |
| 2,730,532 | A | 1/1956 | Martin |
| 2,881,198 | A | 4/1959 | Bailey et al. |
| 2,992,708 | A | 7/1961 | Lyon |
| 3,018,250 | A | 1/1962 | Anderson et al. |
| 3,018,291 | A | 1/1962 | Anderson et al. |
| 3,024,237 | A | 3/1962 | Drummond |
| 3,072,700 | A | 1/1963 | De Wit et al. |
| 3,098,825 | A | 7/1963 | Shiffler |
| 3,100,673 | A | 8/1963 | Ulmer et al. |
| 3,172,892 | A | 3/1965 | Le Suer et al. |
| 3,202,678 | A | 8/1965 | Stuart et al. |
| 3,219,666 | A | 11/1965 | Norman et al. |
| 3,272,746 | A | 9/1966 | Le Suer et al. |
| 3,296,161 | A | 1/1967 | Kulpa |
| 3,296,195 | A | 1/1967 | Geoseens |
| 3,361,673 | A | 1/1968 | Stuart et al. |
| 3,381,022 | A | 4/1968 | Le Suer |
| 3,627,807 | A | 12/1971 | Bleh et al. |
| 3,637,416 | A | 1/1972 | Misch et al. |
| 3,641,077 | A | 2/1972 | Rochow |
| 3,775,457 | A | 11/1973 | Muraoka et al. |

(Continued)

FOREIGN PATENT DOCUMENTS

| | | |
|---|---|---|
| CH | 313 997 | 5/1956 |

(Continued)

OTHER PUBLICATIONS

The IP.com Journal 7, vol. 2, 9 pp. 57-58 (Sep. 2002), announcing that Yamaguchi, E.S., Friction and Wear Measurements Using a Modified MTM Tribometer, pp. 1-33 published on IP.com on Aug. 7, 2002 as No. IPCOM000009117D.

(Continued)

*Primary Examiner* — Jim Goloboy

(57) ABSTRACT

A lubricating oil composition is disclosed which comprises (a) a major amount of an oil of lubricating viscosity, and (b) an oil-soluble tetra-functional hydrolyzable silane compound of the general formula Si—$X_4$ or a hydrolysis product thereof, wherein each X is independently a hydroxyl-containing group, hydrocarbyloxy-containing group, acyloxy-containing group, amino-containing group, monoalkyl amino-containing group or a dialkyl amino-containing group, and further wherein the lubricating oil composition is free of any zinc dialkyl dithiophosphate.

24 Claims, 2 Drawing Sheets

U.S. PATENT DOCUMENTS

| | | | | |
|---|---|---|---|---|
| 3,793,207 | A | | 2/1974 | Burrous |
| 3,803,197 | A | | 4/1974 | Anderson et al. |
| 3,912,764 | A | | 10/1975 | Palmer, Jr. |
| 4,051,053 | A | | 9/1977 | Elliott et al. |
| 4,113,761 | A | | 9/1978 | Kreuzburg et al. |
| 4,152,499 | A | | 5/1979 | Boerzel et al. |
| 4,234,435 | A | | 11/1980 | Meinhardt et al. |
| 4,288,604 | A | | 9/1981 | Magee et al. |
| 4,323,690 | A | | 4/1982 | Montle et al. |
| 4,327,140 | A | * | 4/1982 | Preston ..... 428/65.8 |
| 4,541,838 | A | | 9/1985 | Zaweski et al. |
| 4,572,791 | A | | 2/1986 | Onopchenko et al. |
| 4,612,132 | A | | 9/1986 | Wollenberg et al. |
| 4,691,039 | A | | 9/1987 | Aasen et al. |
| 4,727,173 | A | | 2/1988 | Mendicino |
| 4,746,446 | A | | 5/1988 | Wollenberg et al. |
| 4,747,965 | A | | 5/1988 | Wollenberg |
| 4,752,647 | A | | 6/1988 | Inaba et al. |
| 4,761,492 | A | | 8/1988 | Childress et al. |
| 4,762,939 | A | | 8/1988 | Mendicino |
| 4,999,446 | A | | 3/1991 | Moody et al. |
| 5,084,590 | A | | 1/1992 | Ritscher et al. |
| 5,103,034 | A | | 4/1992 | Cho et al. |
| 5,112,507 | A | | 5/1992 | Harrison |
| 5,120,485 | A | | 6/1992 | Johnson |
| 5,137,978 | A | | 8/1992 | Degonia et al. |
| 5,137,980 | A | | 8/1992 | Degonia et al. |
| 5,175,225 | A | | 12/1992 | Ruhe, Jr. |
| 5,241,003 | A | | 8/1993 | Degonia et al. |
| 5,266,186 | A | | 11/1993 | Kaplan |
| 5,286,799 | A | | 2/1994 | Harrison et al. |
| 5,319,030 | A | | 6/1994 | Harrison et al. |
| 5,334,321 | A | | 8/1994 | Harrison et al. |
| 5,356,552 | A | | 10/1994 | Harrison et al. |
| 5,362,897 | A | | 11/1994 | Harada et al. |
| 5,405,545 | A | | 4/1995 | Horodysky et al. |
| 5,523,417 | A | | 6/1996 | Blackborow et al. |
| 5,527,937 | A | | 6/1996 | Standke et al. |
| 5,534,173 | A | | 7/1996 | Faber et al. |
| 5,565,528 | A | | 10/1996 | Harrison et al. |
| 5,616,668 | A | | 4/1997 | Harrison et al. |
| 5,625,004 | A | | 4/1997 | Harrison et al. |
| 5,670,257 | A | | 9/1997 | Sakai et al. |
| 5,674,820 | A | | 10/1997 | Manka et al. |
| 5,716,912 | A | | 2/1998 | Harrison et al. |
| 5,728,858 | A | | 3/1998 | Lewis et al. |
| 5,777,025 | A | | 7/1998 | Spencer et al. |
| 5,783,720 | A | | 7/1998 | Mendicino et al. |
| 5,792,729 | A | | 8/1998 | Harrison et al. |
| 5,817,853 | A | | 10/1998 | Friedrich et al. |
| 6,140,445 | A | | 10/2000 | Su et al. |
| 6,166,237 | A | | 12/2000 | Simandan et al. |
| 6,372,696 | B1 | | 4/2002 | Tipton |
| 6,454,969 | B1 | | 9/2002 | Nishihara |
| 6,593,433 | B2 | | 7/2003 | Agostini |
| 6,884,314 | B2 | | 4/2005 | Cross et al. |
| 6,887,835 | B1 | * | 5/2005 | Migdal et al. ..... 508/204 |
| 6,955,728 | B1 | | 10/2005 | Van Ooj et al. |
| 7,867,960 | B2 | * | 1/2011 | Yamaguchi et al. ..... 508/564 |
| 2005/0176594 | A1 | | 8/2005 | Grabowski et al. |
| 2008/0058231 | A1 | | 3/2008 | Yamaguchi et al. |
| 2008/0058232 | A1 | | 3/2008 | Yamaguchi et al. |

FOREIGN PATENT DOCUMENTS

| | | | | |
|---|---|---|---|---|
| CN | 1683479 | | | 10/2005 |
| EP | 0 542 380 | | | 5/1993 |
| EP | 0 355 895 | | | 12/1994 |
| EP | 0 465 723 | | | 3/1995 |
| EP | 0 651 005 | | | 5/1995 |
| EP | 0 602 863 | | | 5/1997 |
| GB | 707 906 | | | 4/1954 |
| GB | 0760097 | | | 10/1956 |
| GB | 790 281 | | | 2/1958 |
| GB | 1 229 892 | | | 4/1971 |
| GB | 1 441 335 | | | 6/1976 |
| JP | 8 337788 | | | 12/1996 |
| JP | 8-337788 | | | 12/1996 |
| JP | 10310786 | A | * | 11/1998 |
| JP | 200226881 | | | 8/2002 |
| JP | 2004231560 | | | 8/2004 |
| SU | 979548 | A | * | 12/1982 |
| WO | WO 94 02572 | | | 2/1994 |
| WO | WO 2004/005439 | | | 1/2004 |

OTHER PUBLICATIONS

Yamaguchi, E.S., "Soot Wear in Diesel Engines", Journal of Engineering Tribology, Proceedings of the Institution of Mechanical Engineers Part J. vol. 220, No. J5, pp. 463-469 (2006).

* cited by examiner

LUBRICATING OIL COMPOSITIONS

BACKGROUND OF THE INVENTION

1. Technical Field

The present invention generally relates to lubricating oil compositions for reducing wear in engines.

2. Description of the Related Art

Phosphorus, particularly the phosphorus delivered by zinc dialkyldithiophosphate (ZDDP), has been the predominant antiwear agent in fully formulated lubricants for the past 50 years. Studies have suggested that phosphorus may poison catalytic converters used in gasoline-fueled engines to reduce exhaust emissions of unburned hydrocarbons and oxides of nitrogen, see, e.g., Spearot et al., "Engine Oil Phosphorus Effects on Catalytic Converter Performance in Federal Durability and High Speed Vehicle Tests," SAE Technical Paper 770637 (1977); Caracciolo et al., "Engine Oil Additive Effects on the Deterioration of a Stoichiometric Emissions Control (C-4) System," SAE Technical Paper 790941 (1979); and Ueda et al., "Engine Oil Additive Effects on Deactivation of Monolithic Three-Way Catalysts and Oxygen Sensors," SAE Technical Paper 940746 (1994). As the environmental regulations governing tailpipe emissions have tightened, the allowable concentration of phosphorus in engine oils has been significantly reduced with further reductions in the phosphorus content of the engine oils being likely in the next category, i.e., GF-5 to perhaps 0.05 wt. %.

Many partial solutions exist, where either Zn, P or S have been partially or totally eliminated. In one approach, Zhang et al., "Tribofilms Generated From ZDDP and ashless dialkyldithiophosphate (DDP) on Steel Surfaces, Part 1, Growth, Wear, and Morphological Aspects," Tribology Letters, Vol. 19, 3, pp 211-220 (2005) studied the growth and morphology of tribofilms generated from ZDDP and a DDP over a wide range of rubbing times (10 seconds to 10 hours) and concentrations (0.1 to 5 wt. % ZDDP), using atomic force microscopy (AFM), X-ray photoelectron spectroscopy (XPS), and X-ray absorption near edge structure (XANES) spectroscopy at the O, P, and S K-edges and the P, S, and Fe L-edges. The major components of all films generated using a Cameron-Plint tester on 52100 steel are Zn and Fe phosphates and polyphosphates. The average thickness of these phosphate films has been measured using P K-edge XANES and XPS profiling. For ZDDP, a very significant phosphate film (about 100 Å thick) forms after 10 seconds, while film development for DDP is substantially slower. However, for both additives, the average film thickness increases to 600 to 800 Å after 30 minutes of rubbing, before leveling off or decreasing.

The antiwear properties of pure ZDDP and in combination with DDP at different rubbing times and concentrations have also been examined. It was found that under all conditions, the performance of ZDDP as an antiwear agent is superior to that of DDP. However, DDP has no adverse effect on the performance of ZDDP when the two are mixed, suggesting that DDP can be used with ZDDP, thereby reducing the amount of total ash.

U.S. Pat. No. 5,405,545 discloses a lubricant additive having antiwear and antioxidant properties and is the reaction product of a thiodicarboxylic acid and an ether amine which is post-reacted with an aliphatic alcohol, an aliphatic amine, and/or a trialkylphosphite.

U.S. Pat. No. 5,674,820 ("the '820 patent") discloses a composition comprising: (A) a compound represented by the formula:

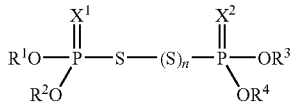

wherein $R^1$, $R^2$, $R^3$, and $R^4$ are independently hydrocarbyl groups, and $X^1$ and $X^2$ are independently O or S, and n is 0 to 3; and (B) an acylated nitrogen-containing compound having a substituent of at least 10 aliphatic carbon atoms. The '820 patent further discloses that the composition can contain a second phosphorus compound other than (A), with the second phosphorus compound being a phosphorus acid, phosphorus acid ester, phosphorus acid salt, or derivative thereof.

The above references largely describe P- or S-containing supplemental wear inhibitors. Unfortunately, the tightening of emission requirements requires wear inhibitors with relatively no P, S, and/or Zn content. Trialkylsilanes have been disclosed to add thermal stability to lubricants in U.S. Pat. No. 4,572,791 and phenyltrialkylsilanes were disclosed for oxidation improvement in U.S. Pat. No. 5,120,485. Trifunctional hydrolysable silanes have found some applications in fuels and lubricant compositions, e.g., U.S. Pat. No. 4,541,838 discloses additive mixtures of an organic nitrate ignition accelerator and a trialkoxysilane for use in fuel compositions. U.S. Pat. No. 6,887,835 discloses bis-(trialkoxysilyl)alkyl polysulfides as well as other linking groups including polysiloxanes. The bis and polymeric silane compounds showed a reduction in the Falex 4-ball wear scar using the ASTM D 4172 test.

U.S. Patent Application Publication Nos. 20080058231 ("the '231 application") and 20080058232 ("the '232 application") disclose a lubricating oil composition containing (a) a major amount of an oil of lubricating viscosity; and (b) a tetra functional hydrolyzable silane. Each of the examples in the '231 and '232 applications further disclose that the lubricating oil compositions contain a zinc dihydrocarbyl dithiophosphate.

Russian Patent No. SU-245955 (Jun. 11, 1969) discloses lubricant additives which improve the antifriction and anticorrosion characteristics of lubricating oils when used in amounts of 2 to 35 wt. %, and preferably 5 wt. % are trialkoxyorganosilanes of the general formula $(AlkO)_3SiRR'$ (where AlkO is an alkoxy group, R is alkyl, aryl or alkenyl group, and R' is a functional group such as such as $NH_2$, $CO_2H$, COH, OH, or CN).

Great Britain Patent No. 1 441 335 discloses lubricant compositions to improve antifatigue containing about 0.01 to 5% weight of a condensation polymer derived from a trialkoxysilanes of the formula $R—Si(OR^1)_3$ where R is a $C_{1-12}$ alkyl or $C_{2-24}$ alkoxyalkyl, and $R^1$ is a $C_{1-12}$ alkyl or $C_{2-12}$ alkoxyalkyl, where alkoxyalkyl means an ether group represented by $—C_n—O—C_m—$ wherein the sum of n plus m is 2 to 24 in the case of R and 2 to 12 in the case of $R^1$.

Japanese Patent Publication No. 8-337788 (Dec. 24, 1996) ("the '788 publication") discloses additives consisting of silane compounds, e.g., (a) $R_1Si(OR)_3$, (b) $(R_1)_2Si(OR)_2$, and (c) $(R_1)_3SiOR$ wherein R is H, $C_{1-18}$ alkyl, $C_{2-18}$ alkenyl, $C_{6-18}$ aryl; and $R_1$ is $C_{6-50}$ alkenyl optionally containing a N, O, and/or S atom or substituted with hydroxyl, carbonyl, alkoxycarbonyl, alkenoxycarbonyl or aryloxycarbonyl, or a $C_{6-50}$ aryl.

Accordingly, as demand for further decrease of the phosphorus content and a limit on the sulfur content of lubricating oils is very high, this reduction cannot be satisfied by the present measures in practice and still meet the severe antiwear and oxidation-corrosion inhibiting properties required of today's engine oils. Thus, it would be desirable to develop lubricating oil compositions, and additives and additive packages therefor having relatively low levels of phosphorus and sulfur, and no zinc but which still provide the needed wear and oxidation protection now provided by lubricating oils containing a zinc dialkyl dithiophosphate.

SUMMARY OF THE INVENTION

In accordance with one embodiment of the present invention, a lubricating oil composition is provided comprising (a) a major amount of an oil of lubricating viscosity, and (b) an oil-soluble tetra-functional hydrolyzable silane compound of the general formula Si—$X_4$ or a hydrolysis product thereof, wherein each X is independently a hydroxyl-containing group, hydrocarbyloxy-containing group, acyloxy-containing group, amino-containing group, monoalkyl amino-containing group or dialkyl amino-containing group, and further wherein the lubricating oil composition is free of any zinc dialkyl dithiophosphate compound.

In accordance with a second embodiment of the present invention, a lubricating oil composition is provided comprising (a) a major amount of an oil of lubricating viscosity, and (b) an oil-soluble tetra-functional hydrolyzable silane compound of the general formula Si—$X_4$ or a hydrolysis product thereof, wherein each X is independently a hydroxyl-containing group, hydrocarbyloxy-containing group, acyloxy-containing group, amino-containing group, monoalkyl amino-containing group or dialkyl amino-containing group, and further wherein the lubricating oil composition is free of any zinc dialkyl dithiophosphate compound and has a wear reducing property greater than or comparable to a corresponding lubricating oil composition in which the oil-soluble tetra-functional hydrolyzable silane compound in the lubricating oil composition is replaced with a zinc dialkyl dithiophosphate compound.

In accordance with a third embodiment of the present invention, a lubricating oil composition is provided comprising (a) a major amount of an oil of lubricating viscosity, and (b) an oil-soluble partially non-hydrolyzable silane of formula II:

$$(R^4)_n Si(OR^5)_{4-n} \quad \text{(II)}$$

wherein n is an integer of 1, 2 or 3, each —$OR^5$ moiety is independently a hydrolyzable group and each $R^4$ is independently a non-hydrolyzable group, and further wherein the lubricating oil composition is free of any zinc dialkyl dithiophosphate compound.

In accordance with a fourth embodiment of the present invention, a method for reducing wear in an internal combustion engine is provided comprising the step of operating the internal combustion engine with a lubricating oil composition comprising (a) a major amount of an oil of lubricating viscosity, and (b) an oil-soluble tetra-functional hydrolyzable silane compound of the general formula Si—$X_4$ or a hydrolysis product thereof, wherein each X is independently a hydroxyl-containing group, hydrocarbyloxy-containing group, acyloxy-containing group, amino-containing group, monoalkyl amino-containing group or dialkyl amino-containing group, and further wherein the lubricating oil composition is free of any zinc dialkyl dithiophosphate.

In accordance with a fifth embodiment of the present invention, there is provided an internal combustion engine lubricated with a lubricating oil composition comprising (a) a major amount of an oil of lubricating viscosity, and (b) an oil-soluble tetra-functional hydrolyzable silane compound of the general formula Si—$X_4$ or a hydrolysis product thereof, wherein each X is independently a hydroxyl-containing group, hydrocarbyloxy-containing group, acyloxy-containing group, amino-containing group, monoalkyl amino-containing group or dialkyl amino-containing group, and further wherein the lubricating oil composition is free of any zinc dialkyl dithiophosphate compound.

By employing the oil-soluble tetra-functional hydrolyzable silane compound and/or oil-soluble partially non-hydrolyzable silane in a lubricating oil composition of the present invention in the absence of any zinc dialkyl dithiophosphate compound, it has unexpectedly been discovered that the lubricating oil composition advantageously possesses improved or relatively comparable wear reducing properties as compared to a corresponding lubricating oil composition in which the oil-soluble tetra-functional hydrolyzable silane compound in the lubricating oil composition is replaced with a zinc dialkyl dithiophosphate compound. In addition, the wear inhibition can be achieved with the lubricating oil compositions of the present invention while also employing relatively low levels or free of any phosphorus and/or sulfur content.

DETAILED DESCRIPTION OF THE PREFERRED EMBODIMENTS

Figure 1:
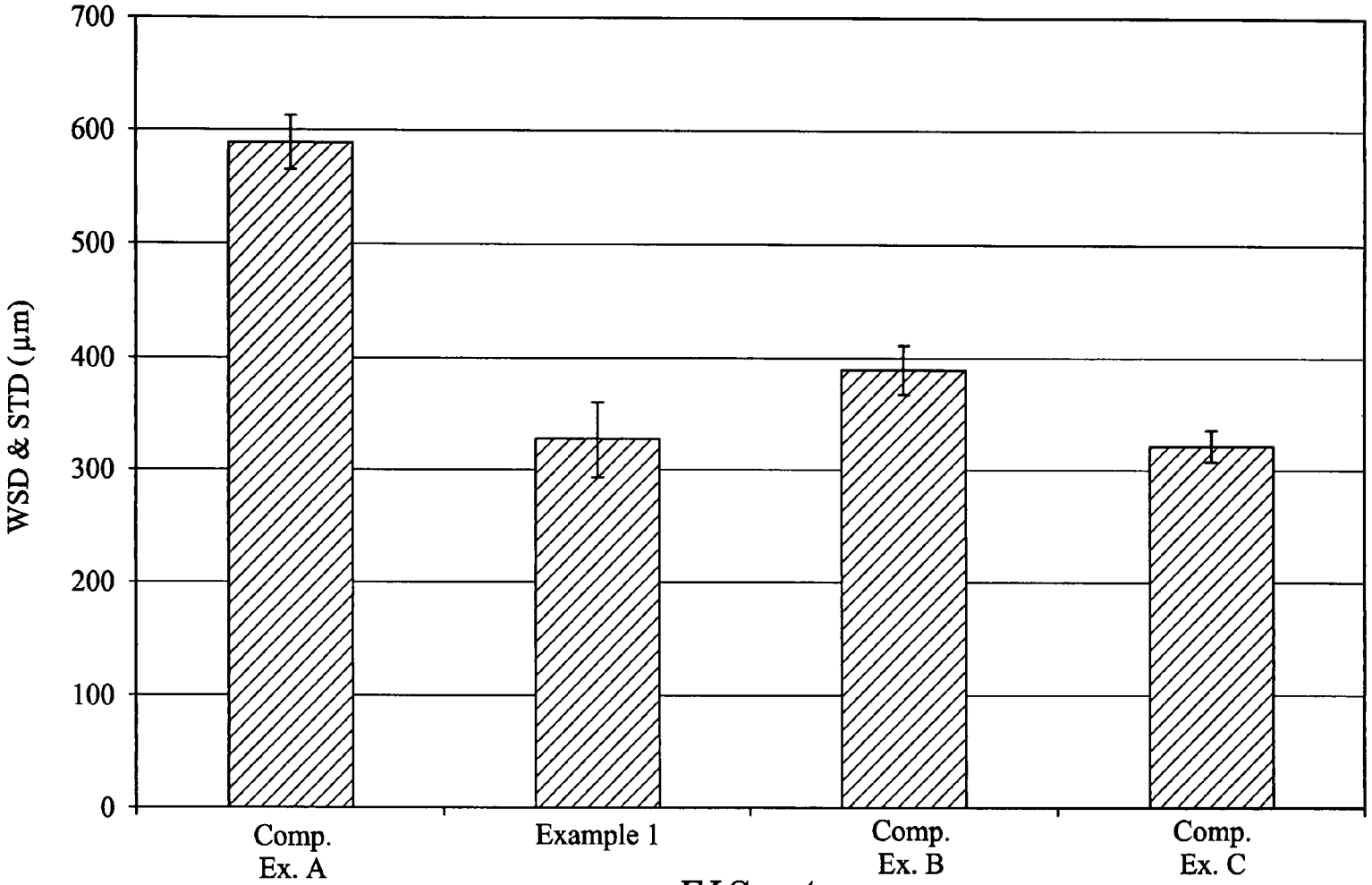
FIG. 1 is a bar graph comparing the wear performance of the lubricating oil composition of Example 1 versus the lubricating oil compositions of Comparative Examples A-C.

The present invention is directed to a lubricating oil composition containing at least (a) a major amount of an oil of lubricating viscosity and (b) an oil-soluble tetra-functional hydrolyzable silane compound of the general formula Si—$X_4$ or a hydrolysis product thereof, wherein each X is independently a hydroxyl-containing group, hydrocarbyloxy-containing group, acyloxy-containing group, amino-containing group, monoalkyl amino-containing group or a dialkyl amino-containing group, and further wherein the lubricating oil composition is free of any zinc dialkyl dithiophosphate. In one embodiment, the lubricating oil composition of the present invention is substantially free of any phosphorus and/or sulfur content, e.g., a phosphorus content not exceeding 0.08 wt. %, more preferably not exceeding 0.05 wt. % and most preferably 0 wt. % and low levels of sulfur, i.e., not exceeding 0.2 wt. %. The amount of phosphorus and sulfur in the lubricating oil composition of the present invention is measured according to ASTM D4951.

The oil of lubricating viscosity for use in the lubricating oil compositions of this invention, also referred to as a base oil, is typically present in a major amount, e.g., an amount of greater than 50 wt. %, preferably greater than about 70 wt. %, more preferably from about 80 to about 99.5 wt. % and most preferably from about 85 to about 98 wt. %, based on the total weight of the composition. The expression "base oil" as used herein shall be understood to mean a base stock or blend of base stocks which is a lubricant component that is produced by a single manufacturer to the same specifications (independent of feed source or manufacturer's location); that meets the same manufacturer's specification; and that is identified by a unique formula, product identification number, or both. The base oil for use herein can be any presently known or later-discovered base oil of lubricating viscosity used in formulating lubricating oil compositions for any and all such applications, e.g., engine oils, marine cylinder oils, functional fluids such as hydraulic oils, gear oils, transmission fluids, etc. Additionally, the base oils for use herein can optionally contain viscosity index improvers, e.g., polymeric alkylmethacrylates; olefinic copolymers, e.g., an ethylene-propylene copolymer or a styrene-butadiene copolymer; and the like and mixtures thereof.

As one skilled in the art would readily appreciate, the viscosity of the base oil is dependent upon the application. Accordingly, the viscosity of a base oil for use herein will ordinarily range from about 2 to about 2000 centistokes (cSt) at 100° Centigrade (C). Generally, individually the base oils used as engine oils will have a kinematic viscosity range at 100° C. of about 2 cSt to about 30 cSt, preferably about 3 cSt to about 16 cSt, and most preferably about 4 cSt to about 12 cSt and will be selected or blended depending on the desired end use and the additives in the finished oil to give the desired grade of engine oil, e.g., a lubricating oil composition having an SAE Viscosity Grade of 0W, 0W-20, 0W-30, 0W-40, 0W-50, 0W-60, SW, 5W-20, 5W-30, 5W-40, 5W-50, 5W-60, 10W, 10W-20, 10W-30, 10W-40, 10W-50, 15W, 15W-20, 15W-30 or 15W-40.Oils used as gear oils can have viscosities ranging from about 2 cSt to about 2000 cSt at 100° C.

Base stocks may be manufactured using a variety of different processes including, but not limited to, distillation, solvent refining, hydrogen processing, oligomerization, esterification, and rerefining. Rerefined stock shall be substantially free from materials introduced through manufacturing, contamination, or previous use. The base oil of the lubricating oil compositions of this invention may be any natural or synthetic lubricating base oil. Suitable hydrocarbon synthetic oils include, but are not limited to, oils prepared from the polymerization of ethylene or from the polymerization of 1-olefins to provide polymers such as polyalphaolefin or PAO oils, or from hydrocarbon synthesis procedures using carbon monoxide and hydrogen gases such as in a Fischer-Tropsch process. For example, a suitable base oil is one that comprises little, if any, heavy fraction; e.g., little, if any, lube oil fraction of viscosity 20 cSt or higher at 100° C.

The base oil may be derived from natural lubricating oils, synthetic lubricating oils or mixtures thereof. Suitable base oil includes base stocks obtained by isomerization of synthetic wax and slack wax, as well as hydrocracked base stocks produced by hydrocracking (rather than solvent extracting) the aromatic and polar components of the crude. Suitable base oils include those in all API categories I, II, III, IV and V as defined in API Publication 1509, 14th Edition, Addendum I, December 1998. Group IV base oils are polyalphaolefins (PAO). Group V base oils include all other base oils not included in Group I, II, III, or IV. Although Group II, III and IV base oils are preferred for use in this invention, these base oils may be prepared by combining one or more of Group I, II, III, IV and V base stocks or base oils.

Useful natural oils include mineral lubricating oils such as, for example, liquid petroleum oils, solvent-treated or acid-treated mineral lubricating oils of the paraffinic, naphthenic or mixed paraffinic-naphthenic types, oils derived from coal or shale, animal oils, vegetable oils (e.g., rapeseed oils, castor oils and lard oil), and the like.

Useful synthetic lubricating oils include, but are not limited to, hydrocarbon oils and halo-substituted hydrocarbon oils such as polymerized and interpolymerized olefins, e.g., polybutylenes, polypropylenes, propylene-isobutylene copolymers, chlorinated polybutylenes, poly(1-hexenes), poly(1-octenes), poly(1-decenes), and the like and mixtures thereof; alkylbenzenes such as dodecylbenzenes, tetradecylbenzenes, dinonylbenzenes, di(2-ethylhexyl)-benzenes, and the like; polyphenyls such as biphenyls, terphenyls, alkylated polyphenyls, and the like; alkylated diphenyl ethers and alkylated diphenyl sulfides and the derivative, analogs and homologs thereof and the like.

Other useful synthetic lubricating oils include, but are not limited to, oils made by polymerizing olefins of less than 5 carbon atoms such as ethylene, propylene, butylenes, isobutene, pentene, and mixtures thereof. Methods of preparing such polymer oils are well known to those skilled in the art.

Additional useful synthetic hydrocarbon oils include liquid polymers of alpha olefins having the proper viscosity. Especially useful synthetic hydrocarbon oils are the hydrogenated liquid oligomers of $C_6$ to $C_{12}$ alpha olefins such as, for example, 1-decene trimer.

Another class of useful synthetic lubricating oils include, but are not limited to, alkylene oxide polymers, i.e., homopolymers, interpolymers, and derivatives thereof where the terminal hydroxyl groups have been modified by, for example, esterification or etherification. These oils are exemplified by the oils prepared through polymerization of ethylene oxide or propylene oxide, the alkyl and phenyl ethers of these polyoxyalkylene polymers (e.g., methyl poly propylene glycol ether having an average molecular weight of 1,000, diphenyl ether of polyethylene glycol having a molecular weight of 500 to 1000, diethyl ether of polypropylene glycol having a molecular weight of 1,000 to 1,500, etc.) or mono- and polycarboxylic esters thereof such as, for example, the acetic esters, mixed $C_3$ to $C_8$ fatty acid esters, or the $C_{13}$ oxo acid diester of tetraethylene glycol.

Yet another class of useful synthetic lubricating oils include, but are not limited to, the esters of dicarboxylic acids e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acids, alkyl malonic acids, alkenyl malonic acids, etc., with a variety of alcohols, e.g., butyl alcohol, hexyl alcohol, dodecyl alcohol, 2-ethylhexyl alcohol, ethylene glycol, diethylene glycol monoether, propylene glycol, etc. Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include, but are not limited to, those made from carboxylic acids having from about 5 to about 12 carbon atoms with alcohols, e.g., methanol, ethanol, etc., polyols and polyol ethers such as neopentyl glycol, trimethylol propane, pentaerythritol, dipentaerythritol, tripentaerythritol, and the like.

Silicon-based oils such as, for example, polyalkyl-, polyaryl-, polyalkoxy- or polyaryloxy-siloxane oils and silicate oils, comprise another useful class of synthetic lubricating oils. Specific examples of these include, but are not limited to, tetraethyl silicate, tetra-isopropyl silicate, tetra-(2-ethylhexyl) silicate, tetra-(4-methyl-hexyl)silicate, tetra-(p-tert-butylphenyl)silicate, hexyl-(4-methyl-2-pentoxy)disiloxane, poly(methyl)siloxanes, poly(methylphenyl)siloxanes, and the like.

The lubricating oil may be derived from unrefined, refined and rerefined oils, either natural, synthetic or mixtures of two or more of any of these of the type disclosed hereinabove.

Unrefined oils are those obtained directly from a natural or synthetic source (e.g., coal, shale, or tar sands bitumen) without further purification or treatment. Examples of unrefined oils include, but are not limited to, a shale oil obtained directly from retorting operations, a petroleum oil obtained directly from distillation or an ester oil obtained directly from an esterification process, each of which is then used without further treatment. Refined oils are similar to the unrefined oils except they have been further treated in one or more purification steps to improve one or more properties. These purification techniques are known to those of skill in the art and include, for example, solvent extractions, secondary distillation, acid or base extraction, filtration, percolation, hydrotreating, dewaxing, etc. Rerefined oils are obtained by treating used oils in processes similar to those used to obtain refined oils. Such rerefined oils are also known as reclaimed or reprocessed oils and often are additionally processed by techniques directed to removal of spent additives and oil breakdown products.

Lubricating oil base stocks derived from the hydroisomerization of wax may also be used, either alone or in combination with the aforesaid natural and/or synthetic base stocks. Such wax isomerate oil is produced by the hydroisomerization of natural or synthetic waxes or mixtures thereof over a hydroisomerization catalyst.

Natural waxes are typically the slack waxes recovered by the solvent dewaxing of mineral oils; synthetic waxes are typically the wax produced by the Fischer-Tropsch process.

The oil-soluble tetra-functional hydrolyzable silane compounds for use in the lubricating oil composition of the present invention are represented by the structure of the general formula Si—$X_4$ or a hydrolysis product thereof, wherein each X is independently a hydroxyl-containing group, hydrocarbyloxy-containing group, acyloxy-containing group, amino-containing group, monoalkyl amino-containing group and a dialkyl amino-containing group. Suitable hydrocarbyloxy-containing groups for X include, by way of example, —OR wherein R is a $C_1$ to $C_{20}$ hydrocarbyl group. Examples of such hydrocarbyloxy-containing groups include, but are not limited to, a $C_1$ to $C_6$ alkoxy group, $C_6$ to $C_{20}$ aryloxy group, $C_6$ to $C_{20}$ alkylaryloxy group, $C_6$ to $C_{20}$ arylalkyloxy group, $C_6$ to $C_{20}$ cycloalkyloxy group, $C_6$ to $C_{20}$ cycloalkylalkyloxy group, $C_6$ to $C_{20}$ alkylcycloalkyloxy group and the like and mixtures thereof. In one embodiment, each X is independently a $C_1$ to $C_6$ alkoxy group, $C_6$ to $C_{20}$ aryloxy group, and a $C_1$ to $C_6$ acyloxy group and preferably a $C_1$ to $C_6$ alkoxy group due in part to their commercial availability. The hydrolyzable groups employed may be hydrolyzed by water, undergo alcoholysis, transesterifications reactions, and/or produce polysiloxanes derivatives by condensation. The tetracoordination of these silane compounds provide for three dimensional film formation with the simultaneous properties of having great hardness and high mechanical resilience.

The term "hydrolyzable group" as used herein refers to a group which either is directly capable of undergoing condensation reactions under appropriate conditions or which is capable of hydrolyzing under appropriate conditions, thereby yielding a compound, which is capable of undergoing condensation reactions. Appropriate conditions include acidic or basic aqueous conditions, optionally in the presence of a condensation catalyst. Accordingly, the term "non-hydrolyzable group" as used herein refers to a group not capable of either directly undergoing condensation reactions under appropriate conditions or of hydrolyzing under the conditions listed above for hydrolyzing the hydrolyzable groups.

One class of oil-soluble tetra-functional hydrolyzable silane compounds is represented by the structure of formula I or a hydrolysis product thereof:

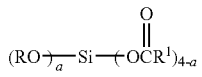

(I)

wherein each R is independently a substituted or unsubstituted $C_1$ to $C_{20}$ hydrocarbyl group including, by way of example, a straight or branched chain alkyl, cycloalkyl, alkcycloalkyl, aryl, alkylaryl, arylalkyl as described above and substituted hydrocarbyl groups having one or more substituents selected from hydroxy, alkoxy, ester or amino groups; each $R^1$ is independently straight or branched chain alkyl, cycloalkyl and aryl; and a is an integer of 0 to 4. In one embodiment, an oil-soluble tetra-functional hydrolyzable silane compound of formula I may have at least one $C_1$ to $C_{20}$ hydrocarbyl group R which is substituted with one or more substituents selected from hydroxyl, alkoxy, ester or amino groups, and preferably at least one substituted hydrocarbyl group is derived from a glycol monoether or an amino alcohol.

The substituted hydrocarbyl groups can be attached to the silicon-oxygen via alkylene or arylene bridging groups, which may be interrupted by oxygen or —NH— groups or terminated by an amino, monoalkyl amino or dialkyl amino where the alkyl group is from 1 to 8 carbon atoms. Thus, glycols and glycol monoethers, polyhydric alcohols or polyhydric phenols, can be reacted via alcoholysis with the (RO) group above, typically a lower tetraalkoxysilane (usually a methoxysilane or ethoxysilane), to form oxygen interrupted substituent groups. For example, oil-soluble tetraethoxysilane can be reacted with glycol monoether residues to replace three ethoxy groups or four ethoxy groups. To replace four ethoxy groups, a small amount of a catalyst is employed, such as sodium to form an alkali metal alkoxide. Preferred oil-soluble tetraalkyoxysilanes prepared from glycol monoethers are represented by the formula $Si(OCH_2CH_2OR^a)_4$ where $R^a$ is independently alkyl, cycloalkyl or aryl. Similarly, alcoholysis of the tetraalkoxysilane can be conducted with amino alcohols to form aminoalkoxysilanes. Particularly preferred glycol monoethers are selected from HO—$(CH_2CH_2)_mR^2$ where m is from 1 to 10 and $R^2$ is $C_1$ to $C_6$ alkyl. Particularly preferred amino alcohols are selected from HO—$(CH_2CH_2)_mN(R^3)_2$ where $R^3$ is independently hydrogen or $C_1$ to $C_6$ alkyl, preferably a monoalkyl or dialkyl and more preferably dialkyl. Hydrolysis products of formula I can be formed via the hydrolysis and condensation of the compounds of formula I.

Tetra(acyloxy)silanes are typically more susceptible to hydrolysis than alkoxysilanes or aryloxysilanes. Accordingly, in one embodiment, the integer a in formula I is an integer greater than zero, e.g., 1 to 4, preferably 2 to 4 and even more preferably 4. A preferred tetra-functional hydrolyzable silane of formula I is where R is independently an alkyl, aryl, alkaryl and arylalkyl group, and preferably straight and branched chain alkyl groups such as a $C_1$ to $C_6$ alkyl group.

Representative examples of oil-soluble tetra-functional hydrolyzable silane compounds represented by formula I include tetramethoxysilane, tetraethoxysilane, tetrapropoxysilane, tetraisopropoxysilane, tetrabutoxysilane, tetraisobutoxysilane, tetrakis(methoxyethoxy)silane, tetrakis (methoxypropoxy)silane, tetrakis(ethoxyethoxy)silane, tetrakis(methoxyethoxyethoxy)silane, trimethoxyethoxysilane, dimethoxydiethoxysilane, triethoxymethoxysilane, tetra-(4-methyl2-pentoxy)silane, and tetra-(2-ethylhexoxy) silane. Hydrolysis products may be represented by poly-(dimethoxysiloxane), poly(diethoxysiloxane), poly (dimethoxy-diethoxysiloxane), tetrakis(trimethoxysiloxy) silane, tetrakis-(triethoxysiloxy)silane, and the like. In addition, examples of oil-soluble tetrafunctional silanes with acyloxy groups are tetraacetoxyoxysilane, silicon tetrapropionate and silicon tetrabutyrate.

Silicon esters are organic silicon compounds that contain an oxygen bridge from the silicon atom to the organic group, i.e., ═Si—O—$R_i$. The earliest reported organic silicon compounds containing four oxygen bridges were derivatives of orthosilicic acid, $Si(OH)_4$. Silicic acid behaves as though it is dibasic with pKs at about 9.8 and about 11.8 and can form polymers such as silica gels and silicates by condensation of the silanol groups or reaction of silicate ions. Commonly organic silicon compounds are referred to by their organic nomenclature, for example the alkoxy derivatives $Si(OC_2H_5)_4$ is tetraethoxysilane and the acyloxy derivatives $Si(OOCCH_3)_4$ is tetraacetooxysilane.

In general, the esters of orthosilicic acid and their lower condensation stages are not regarded as organosilanes in the strictest sense; since unlike organo(organoxy)silanes, tetra (hydrocarbyloxy)silanes can be synthesized directly from silicon or suitable natural silicates and alcohols. Tetra(hydrocarbyloxy)silanes have a wide variety of applications which are somewhat dependent on whether the Si—O—$R_i$ bond is expected to remain intact or to be hydrolyzed in the final application. Tetra(hydrocarblyoxy)silanes may contain up to four matrix coordinations in the polymeric hydrolysates and thus can lead to more rigid films than alkyl and aryltrialkoxysilanes which have three matrix coordinations. Likewise, monoalkoxysilane can only form a monolayer or partial monolayer. Hydrolysis on adsorption onto a metal surface has been observed at room temperature for carboxylic acid esters and certain phosphate esters. Thus, the surface may be reactive. However, both adsorption onto a metal surface and rubbing under load typically are needed to produce the mature antiwear film in the case of the esters of orthosilicic acid. The films thus produced have been found to contain Si and are effective in preventing wear, as seen in the examples below. The film could be a monolayer of multilayer. The multilayer could be either interconnected through a loose network structure, intermixed, or both and are in fact formed by most deposition techniques. These films can also contain other surface active components, such as detergents, antiwear agents, dispersants, etc. which can lead to unique protective films. The formation of covalent bonds to the surface proceeds with a certain amount of reversibility with the degree of hydrogen bonding decreasing with further condensation. Likewise, with the removal of water the bonds may form, break and reform to relieve internal stress of the film and likewise can permit a positional displacement of interface components.

For example, the Si—O—$R_i$ bond undergoes a variety of reactions apart from the hydrolysis and condensation. An alkoxy moiety can improve oil solubility and stability with increased steric bulk, increased size of the alkoxy groups can decrease the rate of hydrolysis. Tetra(alkoxy)silanes and tetra (aryloxy)silanes possess excellent thermal stability and liquid behavior over a broad temperature range that widens with length and branching of the substituents. Acyloxy- and amino-substituted silanes are typically more susceptible to hydrolysis than the alkoxysilanes. The increased rate can be attributed to the acidic or basic character of the byproducts. Therefore, catalytic amounts of amine or acid are often added to accelerate this rate.

The oil-soluble tetra-functional hydrolyzable silane compounds disclosed herein may be prepared by a wide number of synthetic pathways. The oldest principal method of silicon ester production was described by Von Ebelman's 1846 synthesis:

$$SiCl_4+4C_2H_5OH \rightarrow Si(OC_2H_5)_4+4HCl$$

Catalyzed direct reactions of alcohols using silicon metal introduced in the 1940s and 1950s (see U.S. Pat. Nos. 2,473,260 and 3,072,700) became important commercial technology in the 1990s for production of the lower esters via use of a metal alcoholate catalysis, see, e.g., U.S. Pat. No. 4,113,761. Another commercial method used to prepare alkoxysilanes is by transesterification. Transesterification is practical when the alcohol to be esterified has a high boiling point and the leaving alcohol can be removed by distillation. Other representative methods for preparing alkoxysilanes are exemplified as follows:

$$\text{═SiCl}+(RO)_3CH \rightarrow \text{═SiOR}+RCl+ROOCH \quad 1.$$

$$\text{═SiCl}+NaOR \rightarrow \text{═SiOR}+NaCl \quad 2.$$

$$\text{═SiH}+HOR(\text{catalyst}) \rightarrow \text{═SiOR}+H_2 \quad 3.$$

$$\text{═SiOH}+HOR \rightarrow \text{═SiOR}+H_2O \quad 4.$$

$$SiCl+CH_3NO_2 \rightarrow \text{═}SiOCH_3+NO_2Cl \quad 5.$$

$$\text{═SiSH}+HOR \rightarrow \text{═SiOR}+H_2S \quad 6.$$

$$\text{═SiCl}+HOC(O)R \rightarrow \text{═SiOC(O)}R+HCl \quad 7.$$

$$\text{═SiCl}+HONR'R'' \rightarrow \text{═SiONR'R''}+HCl \quad 8.$$

Acyloxysilanes are readily produced by the reaction of an anhydride and a chlorosilane. Aminosilanes are formed by the reaction of hydroxylamines with chlorosilanes and removal of liberated hydrogen chloride by base. Processes for preparing acyloxysilanes and alkoxy-acyloxy-silanes such as di-tert-butoxydiacetoxysilanes are disclosed in U.S. Pat. Nos. 3,296,195; 3,296,161; and 5,817,853 as well as in European Patent Application Publication No. 0 465 723.

Generally, tetraalkoxysilanes are prepared in slurry-phase direct synthesis processes. A catalyst used in this reaction can be copper or a copper compound, but is usually an alkali or alkali metal salt of a high boiling alcohol. Such processes are disclosed in U.S. Pat. Nos. 3,627,807; 3,803,197; 4,113,761; 4,288,604 and 4,323,690. Likewise, for trialkoxysilanes the direct synthesis process employs catalytically-activated silicon particles maintained in suspension in an inert, high boiling solvent and are made to react with an alcohol at an elevated temperature. This type of reaction is disclosed in U.S. Pat. Nos. 3,641,077; 3,775,457; 4,727,173; 4,761,492; 4,762,939; 4,999,446; 5,084,590; 5,103,034; 5,362,897; and 5,527,937.

Slurry-phase reactors for the direct synthesis of alkoxysilanes and tetraalkoxysilanes may be operated in a batchwise or continuous mode. In batchwise operation, a single addition of silicon and catalyst is made to the reactor at the outset and alcohol is added continuously, or intermittently, until the silicon is fully reacted, or reacted to a desired degree of conversion. The alcohol typically is added in the gas phase but liquid phase addition is also feasible. In continuous operation, silicon and catalyst are added to the reactor initially and thereafter to maintain the solids content of the slurry within desired limits. The batchwise mode is illustrated in U.S. Pat. Nos. 4,727,173, 5,783,720, and 5,728,858. The desired reaction products are removed from the reactor in a gas phase mixture along with unreacted alcohol. Isolation of the product is accomplished readily by distillation according to known procedures. Continuous direct synthesis of trialkoxysilanes is disclosed in U.S. Pat. No. 5,084,590 and of tetraalkoxysilanes in U.S. Pat. Nos. 3,627,807; 3,803,197 and 4,752,647.

Generally, the oil-soluble tetra-functional hydrolyzable silane compound is present in the lubricating oil composition of the present invention in a minor amount. For example, in one embodiment, the oil-soluble tetra-functional hydrolyzable silane compound is present in the lubricating oil composition in an amount ranging from about 0.1 to about 5 wt. %, based on the total weight of the lubricating oil composition.

In another embodiment, the lubricating oil compositions of the present invention contain, in addition to the major amount of an oil of lubricating viscosity, one or more oil-soluble partially non-hydrolyzable silane compounds or a mixture of hydrolysis products and partial condensates. The selection of the oil-soluble partially non-hydrolyzable silane additives incorporated into the lubricating compositions of the present invention will depend upon the particular properties to be enhanced or imparted to either the lubricating composition or the formed film coating. One class of oil-soluble partially non-hydrolyzable silane compounds is represented by a compound of formula II (i.e., trifunctional silanes, difunctional silanes, monofunctional silanes, and mixtures thereof):

$$(R^4)_n Si(OR^5)_{4-n} \quad \text{(II)}$$

wherein n is 1, 2 or 3; each —$OR^5$ moiety is independently a hydrolyzable group; and each $R^4$ is independently a non-hydrolyzable group which may optionally carry a functional group. Examples of $R^4$ groups include alkyl groups (e.g., a $C_1$ to $C_6$ alkyl such as methyl, ethyl, n-propyl, isopropyl, n-butyl, s-butyl and t-butyl, pentyl, hexyl or cyclohexyl), and aryl groups (e.g., a $C_6$-$C_{10}$ aryl such as phenyl and naphthyl). Examples of hydrolyzable —$OR^5$ groups include hydrocarbyloxy groups as defined above, e.g., alkoxy groups, e.g., $C_1$ to $C_6$ alkoxy groups such as methoxy, ethoxy, n-propoxy, i-propoxy and butoxy; aryloxy groups, e.g., $C_6$-$C_{10}$ aryloxy such as phenoxy; and acyloxy groups, e.g., $C_1$ to $C_6$ acyloxy such as acetoxy or propionyloxy.

Specific examples of functional groups of $R^4$ include the hydroxyl, ether, amino, monoalkylamino, dialkylamino, amide, carboxyl, mercapto, thioether, acryloxy, cyano, aldehyde, alkylcarbonyl, sulfonic acid and phosphoric acid groups. These functional groups are bonded to the silicon atom via alkylene, or arylene bridging groups, which may be interrupted by oxygen or sulfur atoms or —NH— groups. The bridging groups are derived, for example, from the above-mentioned alkyl, or aryl radicals. Preferably, $R^4$ is a group containing from 1 to 18 carbon atoms, and most preferably from 1 to 8 carbon atoms.

Specific representative examples of oil-soluble partially non-hydrolyzable silane compounds include methyltrimethoxysilane, ethyltrimethoxysilane, propyltrimethoxysilane, butyltrimethoxysilane, isobutyltrimethoxysilane, hexyltrimethoxysilane, 4-methyl-2-pentyltriethoxysilane, 4-methyl-2-pentyltrimethoxysilane, octyltrimethoxysilane, decyltrimethoxysilane, cyclohexyltrimethoxysilane, cyclohexylmethyltrimethoxysilane, dimethyldimethoxysilane, 2-(3-cyclohexenyl)ethyltrimethoxysilane, 3-cyanopropyltrimethoxysilane, phenethyltrimethoxysilane, 3-mercaptopropyltrimethoxysilane, 3-aminopropyltrimethoxysilane, phenyltrimethoxysilane, 3-isocyanopropyltrimethoxysilane, N-(2-aminoethyl)-3-aminopropyltrimethoxysilane, 4-(2-aminoethylaminomethyl)phenethyltrimethoxysilane, phenyltriethoxysilane, ethyltriethoxysilane, propyltriethoxysilane, butyltriethoxysilane, isobutyltriethoxysilane, hexyltriethoxysilane, octyltriethoxysilane, decyltriethoxysilane, cyclohexyltriethoxysilane, cyclohexylmethyltriethoxysilane, 3-cyanopropyltriethoxysilane, 3-ethoxypropyltrimethoxysilane, 3-ethoxypropyltrimethoxysilane, 3-propoxypropyltrimethoxysilane, 3-methoxyethyltrimethoxysilane, 3-ethoxyethyltrimethoxysilane, 3-propoxyethyltrimethoxysilane, 2-ethylhexyltrimethoxysilane, 2-ethylhexyltriethoxysilane, 2-[methoxy(polyethyleneoxy)propyl]heptamethyltrisilane, [methoxy(polyethyleneoxy)propyl]trimethoxysilane, [methoxy(polyethylene-oxy)ethyl]trimethoxysilane, [methoxy(polyethyleneoxy)propyl]-triethoxysilane, [methoxy(polyethyleneoxy)ethyl]triethoxysilane, and the like.

Particularly preferred oil-soluble partially non-hydrolyzable silane additives include methyltrimethoxysilane, ethyltrimethoxysilane, propyltrimethoxysilane, butyltrimethoxysilane, isobutyltrimethoxysilane, hexyltrimethoxysilane, 4-methyl-2-pentyltriethoxysilane, 4-methyl-2-pentyltrimethoxysilane, octyltrimethoxysilane, decyltrimethoxysilane, cyclohexyltrimethoxysilane, cyclohexylmethyltrimethoxysilane, dimethyldimethoxysilane, 2-(3-cyclohexenyl)ethyltrimethoxysilane, 3-cyanopropyltrimethoxysilane, 3-cyanopropyltrimethoxysilane, phenethyltrimethoxysilane, 3-mercaptopropyltrimethoxysilane, 3-aminopropyltrimethoxysilane, 3-aminopropyltriethoxysilane, 3-aminopropyltripropoxysilane, 3-aminopropyltributoxysilane, 4-aminobutyltriethoxysilane, phenyltrimethoxysilane, 3-isocyanopropyltrimethoxysilane, N-(2-aminoethyl)-3-aminopropyltrimethoxysilane, 4-(2-aminoethylaminomethyl)phenethyltrimethoxysilane, phenyltriethoxysilane, ethyltriethoxysilane, propyltriethoxysilane, butyltriethoxysilane, isobutyltriethoxysilane, hexyltriethoxysilane, octyltriethoxysilane, decyltriethoxysilane, cyclohexyltriethoxysilane, cyclohexylmethyltriethoxysilane, 3-cyanopropyltriethoxysilane, 3-ethoxypropyltrimethoxysilane, 3-ethoxypropyltrimethoxysilane, 3-propoxypropyltrimethoxysilane, 3-methoxyethyltrimethoxysilane, 3-ethoxyethyltrimethoxysilane, and 3-propoxyethyltrimethoxysilane.

Even more preferred oil-soluble partially non-hydrolyzable silane additives are selected from 3-aminopropyltrimethoxysilane, 3-aminoporpyltriethoxysilane, 3-aminopropyltripropoxysilane, 3-aminopropyltributoxysilane, and 4-aminobutyltriethoxysilane.

The oil-soluble partially non-hydrolyzable silane compound(s) is present in the lubricating oil compositions of the present invention from about 0.1 to about 5 wt. %, based on the total weight of the lubricating composition. Another aspect to this lubricating oil composition is the further inclusion of from about 0.5 to about 5 wt. % of a partially non-hydrolyzable silane selected from the group consisting of 3-aminopropyltrimethoxysilane, 3-aminoporpyltriethoxysilane, 3-aminopropyltripropoxysilane, 3-aminopropyltributoxysilane, 4-aminobutyltriethoxysilane and mixtures thereof.

Although a condensation catalyst is not an essential ingredient of the lubricating compositions of the present invention, the addition of a condensation catalyst can affect film formation, abrasion resistance and other properties of the coating including stability, porosity, caustic resistance, water resistance and the like. When employing a condensation catalyst, the amount of catalyst used can vary widely, but will generally be present in an amount from about 0.005 to about 1 wt. %, based on the total solids of the composition.

Examples of catalysts which can be incorporated into lubricating compositions of the present invention or more preferably are provided when such lubricating compositions are employed in their intended use, for example as lubricants for engines, gears, hydraulic fluids, etc; are (i) metal acetylacetonates, (ii) diamides, (iii) imidazoles, (iv) amines and ammonium salts, (v) inorganic acids, organic acids, organic sulfonic acids, and their amine salts, (vi) alkali metal salts of carboxylic acids, (vii) alkali and alkaline earth metal hydroxides and oxides, (viii) fluoride salts, and (ix) organometallic. Thus, examples of such catalysts include for group (i) such compounds as aluminum, zinc, iron and cobalt acetylacetonates; group (ii) dicyandiamide; for group (iii) such compounds as 2-methylimidazole, 2-ethyl-4methylimidazole and 1-cyanoethyl-2-propylimidazole; for group (iv), such compounds as benzyldimethylamine, and 1,2-diaminocyclohexane; for group (v), such compounds as hydrochloric acid, sulfuric acid, nitric acid, acetic acid, trifluoromethanesulfonic acid; for group (vi), such compounds as sodium acetate, for group (vii), such compounds as sodium hydroxide, and potassium hydroxide, for group (viii), tetra n-butyl ammonium fluoride, and for group (ix), dibutyltin dilaurate and tin di(2-ethylhexonate), and the like.

In a further aspect, the present invention provides a composition derivable from a partial condensation of the above defined composition. By "partial condensation" and "partial condensate" in connection with the present invention is meant that some of the hydrolyzable groups in the mixture have reacted while leaving a substantial amount of hydrolyzable groups available for a condensation reaction. Typically, a partial condensate means that at least about 20%, preferably at least about 30%, and more preferably at least about 50% of the hydrolyzable groups are still available for condensation reaction.

In another aspect, the present invention provides a composition derivable from a complete condensation of the above defined composition. By "complete condensation" in connection with the present invention is meant that most or all of the hydrolyzable groups in the mixture have reacted. Typically, a complete condensate means that little or no hydrolyzable groups remain available for condensation reaction.

The lubricating oil compositions of the present invention can be conveniently prepared by simply blending or mixing the oil-soluble tetra-functional hydrolyzable silane, optionally with other additives, with the oil of lubricating viscosity. The oil-soluble tetra-functional hydrolyzable silanes may also be preblended as a concentrate or package with various other additives in the appropriate ratios to facilitate blending of a lubricating composition containing the desired concentration of additives. The oil-soluble tetra-functional hydrolyzable silanes are blended with the base oil using a concentration at which they provide improved antiwear effect and are both soluble in the oil and compatible with other additives in the desired finished lubricating oil. Compatibility in this instance generally means that the present compounds as well as being oil soluble in the applicable treat rate also do not cause other additives to precipitate under normal conditions. Suitable oil solubility/compatibility ranges for a given compound of lubricating oil formulation can be determined by those having ordinary skill in the art using routine solubility testing procedures. For example, precipitation from a formulated lubricating oil composition at ambient conditions (about 20° C. to 25° C.) can be measured by either actual precipitation from the oil composition or the formulation of a "cloudy" solution which evidences formation of insoluble wax particles.

The lubricating oil compositions of the present invention may also contain other conventional additives for imparting auxiliary functions to give a finished lubricating oil composition in which these additives are dispersed or dissolved. For example, the lubricating oil compositions can be blended with antioxidants, anti-wear agents, detergents such as metal detergents, rust inhibitors, dehazing agents, demulsifying agents, metal deactivating agents, friction modifiers, pour point depressants, antifoaming agents, co-solvents, package compatibilisers, corrosion-inhibitors, ashless dispersants, dyes, extreme pressure agents and the like and mixtures thereof. A variety of the additives are known and commercially available. These additives, or their analogous compounds, can be employed for the preparation of the lubricating oil compositions of the invention by the usual blending procedures.

Oxidation inhibitors or antioxidants reduce the tendency of base stocks to deteriorate in service, which deterioration can be evidenced by the products of oxidation such as sludge and varnish-like deposits on the metal surfaces and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, ashless oil soluble phenates and sulfurized phenates, phosphosulfurized or sulfurized hydrocarbons, alkyl-substituted diphenylamine, alkyl-substituted phenyl and naphthylamines, phosphorus esters, metal thiocarbamates, ashless thiocarbamates (preferred are dithiocarbamates are methylenebis (dibutyldithiocarbamate), ethylenebis (dibutyldithiocarbamate), and isobutyl disulfide-2,2'-bis(dibutyldithiocarbamate). Preferred phenol type oxidation inhibitors are selected from the group consisting of: 4,4'-methylene bis(2,6-di-tert-butylphenol), 4,4'-bis(2,6-di-tert-butylphenol), 4,4'-bis(2-methyl-6-tert-butylphenol), 2,2'-methylene bis(4-methyl-6-tert-butyl-phenol), 4,4'-butylidenebis(3-methyl-6-tert-butylphenol), 4,4'-isopropylidenebis(2,6-di-tert-butylphenol), 2,2'-methylenebis(4-methyl-6-nonylphenol), 2,2'-isobutylidene-bis(4,6-dimethylphenol), 2,2'-methylenebis(4-methyl-6-cyclohexylphenol), 2,6-di-tert-butyl-4-methyl-phenol, 2,6-di-tert-butyl-4-ethylphenol, 2,4-dimethyl-6-tert-butyl-phenol, 2,6-di-tert-4-(N.N'dimethylaminomethylphenol), 4,4'-thiobis(2-methyl-6-tert-butylphenol), 2,2'-thiobis(4-methyl-6-tert-butylphenol), bis(3-methyl-4-hydroxy-5-tert-butylbenzyl)-sulfide, and bis(3,5-di-tert-butyl-4-hydroxybenzyl). Diphenylamine type oxidation inhibitor: alkylated diphenylamine, octylatedibutylated diphenylamine and a hindered phenolic antioxidant primarily 3,5-di-tert-butyl-4-hydroxcinnamic acid $C_7$ to $C_9$ branched alkyl ester, phenyl-.alpha.-naphthylamine, and alkylated .alpha.-naphthylamine.

Examples of friction modifiers include, but are not limited to, alkoxylated fatty amines; borated fatty epoxides; fatty phosphites, fatty epoxides, fatty amines, borated alkoxylated fatty amines, metal salts of fatty acids, fatty acid amides, glycerol esters, borated glycerol esters; and fatty imidazolines as disclosed in U.S. Pat. No. 6,372,696, the contents of which are incorporated by reference herein; friction modifiers obtained from a reaction product of a $C_4$ to $C_{75}$, preferably a $C_6$ to $C_{24}$, and most preferably a $C_6$ to $C_{20}$, fatty acid ester and a nitrogen-containing compound selected from the group consisting of ammonia, and an alkanolamine and the like and mixtures thereof. The friction modifier can be incorporated in the lubricating oil composition in an amount ranging of from about 0.02 to about 2.0 wt. % of the lubricating oil composition, preferably from about 0.05 to about 1.0 wt. %, and more preferably from about 0.1 to about 0.5 wt. %.

Examples of rust inhibitors include, but are not limited to, nonionic polyoxyalkylene agents, e.g., polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol monooleate, and polyethylene glycol monooleate; stearic acid and other fatty acids; dicarboxylic acids; metal soaps; fatty acid amine salts; metal salts of heavy sulfonic acid; partial carboxylic acid ester of polyhydric alcohol; phosphoric esters; (short-chain) alkenyl succinic acids; partial esters thereof and nitrogen-containing derivatives thereof; synthetic alkarylsulfonates, e.g., metal dinonylnaphthalene sulfonates; and the like and mixtures thereof.

Examples of antifoaming agents include, but are not limited to, polymers of alkyl methacrylate; polymers of dimethylsilicone and the like and mixtures thereof.

Representative examples of metal detergents include sulphonates, alkylphenates, sulfurized alkyl phenates, carboxylates, salicylates, phosphonates, and phosphinates. Commercial products are generally referred to as neutral or overbased. Overbased metal detergents are generally produced by carbonating a mixture of hydrocarbons, detergent acid, for example: sulfonic acid, alkylphenol, carboxylate etc., metal oxide or hydroxides (for example calcium oxide or calcium hydroxide) and promoters such as xylene, methanol and water. For example, for preparing an overbased calcium sulfonate, in carbonation, the calcium oxide or hydroxide reacts with the gaseous carbon dioxide to form calcium carbonate. The sulfonic acid is neutralized with an excess of CaO or $Ca(OH)_2$, to form the sulfonate.

Metal-containing or ash-forming detergents function as both detergents to reduce or remove deposits and as acid neutralizers or rust inhibitors, thereby reducing wear and corrosion and extending engine life. Detergents generally comprise a polar head with a long hydrophobic tail. The polar head comprises a metal salt of an acidic organic compound. The salts may contain a substantially stoichiometric amount of the metal in which case they are usually described as normal or neutral salts, and would typically have a total base number or TBN (as can be measured by ASTM D2896) of from 0 to about 80. A large amount of a metal base may be incorporated by reacting excess metal compound (e.g., an oxide or hydroxide) with an acidic gas (e.g., carbon dioxide). The resulting overbased detergent comprises neutralized detergent as the outer layer of a metal base (e.g., carbonate) micelle. Such overbased detergents may have a TBN of about 150 or greater, and typically will have a TBN of from about 250 to about 450 or more.

Detergents that may be used include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., barium, sodium, potassium, lithium, calcium, and magnesium. The most commonly used metals are calcium and magnesium, which may both be present in detergents used in a lubricant, and mixtures of calcium and/or magnesium with sodium. Particularly convenient metal detergents are neutral and overbased calcium sulfonates having TBN of from about 20 to about 450, neutral and overbased calcium phenates and sulfurized phenates having TBN of from about 50 to about 450 and neutral and overbased magnesium or calcium salicylates having a TBN of from about 20 to about 450. Combinations of detergents, whether overbased or neutral or both, may be used.

Sulfonates may be prepared from sulfonic acids which are typically obtained by the sulfonation of alkyl substituted aromatic hydrocarbons such as those obtained from the fractionation of petroleum or by the alkylation of aromatic hydrocarbons. Examples included those obtained by alkylating benzene, toluene, xylene, naphthalene, diphenyl or their halogen derivatives. The alkylation may be carried out in the presence of a catalyst with alkylating agents having from about 3 to more than 70 carbon atoms. The alkaryl sulfonates usually contain from about 9 to about 80 or more carbon atoms, preferably from about 16 to about 60 carbon atoms per alkyl substituted aromatic moiety.

The oil soluble sulfonates or alkaryl sulfonic acids may be neutralized with oxides, hydroxides, alkoxides, carbonates, carboxylate, sulfides, hydrosulfides, nitrates, borates and ethers of the metal. The amount of metal compound is chosen having regard to the desired TBN of the final product but typically ranges from about 100 to about 220 wt. % (preferably at least about 125 wt. %) of that stoichiometrically required.

Metal salts of phenols and sulfurized phenols are prepared by reaction with an appropriate metal compound such as an oxide or hydroxide and neutral or overbased products may be obtained by methods well known in the art. Sulfurized phenols may be prepared by reacting a phenol with sulfur or a sulfur containing compound such as hydrogen sulfide, sulfur monohalide or sulfur dihalide, to form products which are generally mixtures of compounds in which 2 or more phenols are bridged by sulfur containing bridges.

Carboxylate detergents, e.g., salicylates, can be prepared by reacting an aromatic carboxylic acid with an appropriate metal compound such as an oxide or hydroxide and neutral or overbased products may be obtained by methods well known in the art. The aromatic moiety of the aromatic carboxylic acid can contain heteroatoms, such as nitrogen and oxygen. Preferably, the moiety contains only carbon atoms; more preferably the moiety contains six or more carbon atoms; for example benzene is a preferred moiety. The aromatic carboxylic acid may contain one or more aromatic moieties, such as one or more benzene rings, either fused or connected via alkylene bridges. The carboxylic moiety may be attached directly or indirectly to the aromatic moiety. Preferably the carboxylic acid group is attached directly to a carbon atom on the aromatic moiety, such as a carbon atom on the benzene ring. More preferably, the aromatic moiety also contains a second functional group, such as a hydroxy group or a sulfonate group, which can be attached directly or indirectly to a carbon atom on the aromatic moiety.

Preferred examples of aromatic carboxylic acids are salicylic acids and sulfurized derivatives thereof, such as hydrocarbyl substituted salicylic acid and derivatives thereof. Processes for sulfurizing, for example a hydrocarbyl-substituted salicylic acid, are known to those skilled in the art. Salicylic acids are typically prepared by carboxylation, for example, by the Kolbe-Schmitt process, of phenoxides, and in that case, will generally be obtained, normally in a diluent, in admixture with uncarboxylated phenol.

The dispersant employed in the compositions of this invention can be ashless dispersants such as an alkenyl succinimide, an alkenyl succinic anhydride, an alkenyl succinate ester, and the like, or mixtures of such dispersants.

Examples of ashless dispersants include, but are not limited to, polyalkylene succinic anhydrides; non-nitrogen containing derivatives of a polyalkylene succinic anhydride; a basic nitrogen compound selected from the group consisting of succinimides, carboxylic acid amides, hydrocarbyl monoamines, hydrocarbyl polyamines, Mannich bases, phosphonoamides, and phosphoramides; triazoles, e.g., alkyltriazoles and benzotriazoles; copolymers which contain a carboxylate ester with one or more additional polar function, including amine, amide, imine, imide, hydroxyl, carboxyl, and the like, e.g., products prepared by copolymerization of long chain alkyl acrylates or methacrylates with monomers of the above function; and the like and mixtures thereof. The derivatives of these dispersants, e.g., borated dispersants such as borated succinimides, may also be used.

Generally, ashless dispersants are broadly divided into several groups. One such group is directed to copolymers which contain a carboxylate ester with one or more additional polar function, including amine, amide, imine, imide, hydroxylcarboxyl, and the like. These products can be prepared by copolymerization of long chain alkyl acrylates or methacrylates with monomers of the above function. Such groups include alkyl methacrylate-vinyl pyrrolidinone copolymers, alkyl methacrylate-dialkylaminoethyl methacrylate copolymers and the like. Additionally, high molecular weight amides and polyamides or esters and polyesters such as tetraethylene pentamine, polyvinyl polystearates and other polystearamides may be employed. Preferred dispersants are N-substituted long chain alkenyl succinimides.

Mono and bis alkenyl succinimides are usually derived from the reaction of alkenyl succinic acid or anhydride and alkylene polyamines. The actual reaction product of alkylene or alkenylene succinic acid or anhydride and alkylene polyamine will comprise the mixture of compounds including succinamic acids and succinimides. However, it is customary to designate this reaction product as a succinimide, since this will be a principal component of the mixture. The mono alkenyl succinimide and bis alkenyl succinimide produced may depend on the charge mole ratio of polyamine to succinic groups and the particular polyamine used. A charge mole ratios of polyamine to succinic groups of about 1:1 may produce predominately mono alkenyl succinimide. A charge mole ratio of polyamine to succinic group of about 1:2 may produce predominantly bis alkenyl succinimide.

These N-substituted alkenyl succinimides can be prepared by reacting maleic anhydride with an olefinic hydrocarbon followed by reacting the resulting alkenyl succinic anhydride with the alkylene polyamine. Thus, the alkenyl radical is obtained by polymerizing an olefin containing from 2 to 5 carbon atoms to form a hydrocarbon having a molecular weight ranging from about 450 to 3000. Such olefin monomers are exemplified by ethylene, propylene, 1-butene, 2-butene, isobutene, and mixtures thereof.

In a preferred aspect, the alkenyl succinimide may be prepared by reacting a polyalkylene succinic anhydride with an alkylene polyamine. The polyalkylene succinic anhydride is the reaction product of a polyalkylene (preferably polyisobutene) with maleic anhydride. One can use conventional polyisobutene, or high methylvinylidene polyisobutene in the preparation of such polyalkylene succinic anhydrides. One can use thermal, chlorination, free radical, acid catalyzed, or any other process in this preparation. Examples of suitable polyalkylene succinic anhydrides are thermal PIBSA (polyisobutenyl succinic anhydride) described in U.S. Pat. No. 3,361,673; chlorination PIBSA described in U.S. Pat. No. 3,172,892; a mixture of thermal and chlorination PIBSA described in U.S. Pat. No. 3,912,764; high succinic ratio PIBSA described in U.S. Pat. No. 4,234,435; PolyPIBSA described in U.S. Pat. Nos. 5,112,507 and 5,175,225; high succinic ratio PolyPIBSA described in U.S. Pat. Nos. 5,565,528 and 5,616,668; free radical PIBSA described in U.S. Pat. Nos. 5,286,799, 5,319,030, and 5,625,004; PIBSA made from high methylvinylidene polybutene described in U.S. Pat. Nos. 4,152,499, 5,137,978, and 5,137,980; high succinic ratio PIBSA made from high methylvinylidene polybutene described in European Patent Application Publication No. 0 355 895; terpolymer PIBSA described in U.S. Pat. No. 5,792,729; sulfonic acid PIBSA described in U.S. Pat. No. 5,777,025 and European Patent Application Publication No. 0 542 380; and purified PIBSA described in U.S. Pat. No. 5,523,417 and European Patent Application Publication No. 0 602 863. The disclosures of each of these documents are incorporated herein by reference in their entirety. The polyalkylene succinic anhydride is preferably a polyisobutenyl succinic anhydride. In one preferred embodiment, the polyalkylene succinic anhydride is a polyisobutenyl succinic anhydride having a number average molecular weight of at least 450, more preferably at least 900 to about 3000 and still more preferably from at least about 900 to about 2300.

In another preferred embodiment, a mixture of polyalkylene succinic anhydrides are employed. In this embodiment, the mixture preferably comprises a low molecular weight polyalkylene succinic anhydride component and a high molecular weight polyalkylene succinic anhydride component. More preferably, the low molecular weight component has a number average molecular weight of from about 450 to below 1000 and the high molecular weight component has a number average molecular weight of from 1000 to about 3000. Still more preferably, both the low and high molecular weight components are polyisobutenyl succinic anhydrides. Alternatively, various molecular weights polyalkylene succinic anhydride components can be combined as a dispersant as well as a mixture of the other above referenced dispersants as identified above.

The polyalkylene succinic anhydride can also be incorporated with the detergent which is believed to improve stability and compatibility of the detergent mixture. When employed with the detergent, the ashless dispersant can be added to the composition as a mixture containing from about 0.5 to about 5 percent by weight of the detergent mixture and preferably from about 1.5 to about 4 wt. %.

The preferred polyalkylene amines used to prepare the succinimides are represented by the general formula:

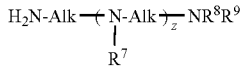

wherein z is an integer of from 0 to 10 and Alk, $R^7$, $R^8$, and $R^9$ are independently a $C_1$-$C_4$ alkyl or alkoxy or hydrogen, with hydrogen being preferred. The alkylene amines include principally methylene amines, ethylene amines, butylene amines, propylene amines, pentylene amines, hexylene amines, heptylene amines, octylene amines, other polymethylene amines and also the cyclic and the higher homologs of such amines as piperazine and amino alkyl-substituted piperazines. They are exemplified specifically by ethylene diamine, triethylene tetraamine, propylene diamine, decamethyl diamine, octamethylene diamine, diheptamethylene triamine, tripropylene tetraamine, tetraethylene pentamine, trimethylene diamine, pentaethylene hexamine, ditrimethylene triamine, 2-heptyl-3-(2-aminopropyl)-imidazoline,4-methyl imidazoline, N,N-dimethyl-1,3-propane diamine, 1,3-bis(2-aminoethyl)imidazoline, 1-(2-aminopropyl)-piperazine, 1,4-bis(2-aminoethyl) piperazine and 2-methyl-1-(2-aminobutyl)piperazine. Higher homologs such as are obtained by condensing two or more of the above-illustrated alkylene amines likewise are useful. The ethylene amines are especially useful. They are described in some detail under the heading "Ethylene Amines" in Encyclopedia of Chemical Technology, Kirk-Othmer, Vol. 5, pp. 898-905 (Interscience Publishers, New York, 1950). The term "ethylene amine" is used in a generic sense to denote a class of polyamines conforming for the most part to the structure $$H_2N(CH_2CH_2NH)_aH$$

wherein a is an integer from 1 to 10.

The individual alkenyl succinimides used in the alkenyl succinimide composition of the present invention can be prepared by conventional processes, e.g., as disclosed in U.S. Pat. Nos. 2,992,708; 3,018,250; 3,018,291; 3,024,237; 3,100,673; 3,172,892; 3,202,678; 3,219,666; 3,272,746; 3,361,673; 3,381,022; 3,912,764; 4,234,435; 4,612,132; 4,747,965; 5,112,507; 5,241,003; 5,266,186; 5,286,799; 5,319,030; 5,334,321; 5,356,552; 5,716,912, the contents of each of which are incorporated by reference herein.

Also included within the term "alkenyl succinimides" are post-treated succinimides such as post-treatment processes involving borate or ethylene carbonate, e.g., as disclosed in U.S. Pat. Nos. 4,612,132 and 4,746,446, the contents of each of which are incorporated by reference herein. The carbonate-treated alkenyl succinimide is a polybutene succinimide derived from polybutenes having a molecular weight of about 450 to about 3000, preferably from about 900 to about 2500, more preferably from about 1300 to about 2300, and most preferably from about 2000 to about 2400, as well as mixtures of these molecular weights. Preferably, it is prepared by reacting, under reactive conditions, a mixture of a polybutene succinic acid derivative, an unsaturated acidic reagent copolymer of an unsaturated acidic reagent and an olefin, and a polyamine, such as taught in U.S. Pat. No. 5,716,912, the contents of which are incorporated herein by reference.

The alkenyl succinimide component can be present in the lubricating oil compositions in an amount ranging from about 1 to about 20 wt. %, preferably about 2 to about 12 wt. %, and more preferably about 4 to about 8 wt. % of the weight of the lubricant composition.

The lubricating composition of the present invention may also contain a viscosity index improver. Examples of the viscosity index improvers include poly-(alkyl methacrylate), ethylene-propylene copolymer, styrene-butadiene copolymer, and polyisoprene. Viscosity index improvers of the dispersant type (having increased dispersancy) or multifunction type are also employed. These viscosity index improvers can be used singly or in combination. The amount of viscosity index improver to be incorporated into an engine oil varies with desired viscosity of the compounded engine oil, and generally in the range of about 0.5 to about 20 wt. % per total amount of the engine oil.

In an alternative embodiment, a lubricating oil composition for internal combustion engines is provided which contains at least (a) a major amount of a base oil of lubricating viscosity; (b) about 0.5 to about 10 wt. % of an oil-soluble tetra-functional hydrolyzable silane compound; (c) about 0.5 to about 10% of a detergent; and (d) about 1 to about 20% of an alkenyl succinimide dispersant derived from a 450 to 3000 average molecular weight polyalkylene; wherein the percent additive is based upon the total weight percent of the lubricating composition and further wherein the lubricating oil composition is free of any zinc dialkyldithiophosphate.

In another embodiment of the present invention, the lubricating oil composition of the present invention possesses a wear reducing property greater than or comparable to a corresponding lubricating oil composition in which the oil-soluble tetra-functional hydrolyzable silane compound or oil-soluble partially non-hydrolyzable silane is replaced with a zinc dialkyl dithiophosphate compound. In one embodiment of the present invention, the lubricating oil composition of the present invention possesses a wear reducing property at least about 15% greater than a corresponding lubricating oil composition in which the oil-soluble tetra-functional hydrolyzable silane compound or oil-soluble partially non-hydrolyzable silane is replaced with a zinc dihydrocarbyl dithiophosphate compound such as a zinc dialkyl dithiophosphate compound. In one embodiment of the present invention, the lubricating oil composition of the present invention possesses a wear reducing property at least about 20% greater than a corresponding lubricating oil composition in which the oil-soluble tetra-functional hydrolyzable silane compound or oil-soluble partially non-hydrolyzable silane is replaced with a zinc dihydrocarbyl dithiophosphate compound such as a zinc dialkyl dithiophosphate compound.

The final application of the lubricating oil compositions of this invention may be, for example, in marine cylinder lubricants in crosshead diesel engines, crankcase lubricants in automobiles and railroads and the like, lubricants for heavy machinery such as steel mills and the like, or as greases for bearings and the like. In one embodiment, the lubricating oil compositions of this invention are used to lubricate an internal combustion engine such as a compression ignition diesel engine, e.g., a heavy duty diesel engine or a compression ignition diesel engine equipped with at least one of an exhaust gas recirculation (EGR) system; a catalytic converter; and a particulate trap.

Whether the lubricating oil composition is fluid or solid will ordinarily depend on whether a thickening agent is present. Typical thickening agents include polyurea acetates, lithium stearate and the like.

The following non-limiting examples are illustrative of the present invention.

COMPARATIVE EXAMPLE A

A baseline formulation was formed containing 3 wt. % succinimide dispersant, 5 wt. % ethylene carbonate post treated bis-succinimide prepared from a 2300 average molecular weight polyisobutenyl succinic anhydride with a heavy polyamine, 0.68% low overbased calcium sulfonate, 4.65% carboxylate detergent, 0.5 wt. % diphenylamine anti-oxidant, 0.5 wt. % hindered phenol anti-oxidant, 5 ppm silicone based foam inhibitor and 10.85 wt. % viscosity improver in 74.7 wt. % of Chevron base oil consisting of 65 wt. % Chevron 100N and 35 wt. % Chevron 220N base oils.

EXAMPLE 1

A baseline lubricating oil formulation was formed containing the same additives, base oil and treat rate as in Comparative Example A. A tetraethoxy silane was formulated into this baseline lubricating oil formulation at 1.5 wt. %.

COMPARATIVE EXAMPLE B

A baseline lubricating oil formulation was formed containing the same additives, base oil and treat rate as in Comparative Example A. A zinc dihydrocarbyl dithiophosphate was formulated into this baseline lubricating oil formulation at 495 ppm based on the phosphorus content.

COMPARATIVE EXAMPLE C

A lubricating oil composition was formed containing 2.35 wt. % succinimide dispersant, 6 wt. % ethylene carbonate post treated bis-succinimide prepared from a 2300 average molecular weight polyisobutylene succinic anhydride with a heavy polyamine, 2.84 wt. % 260 TBN sulfurized calcium phenate detergent, 1.02 wt. % 17 TBN calcium sulfonate detergent, 0.22 wt. % 410 TBN calcium sulfonate detergent, 0.3 wt. % diphenyl amine antioxidant, 0.6 wt. % hindered phenol antioxidant, 0.4 wt. % terephthalic acid salt of a bis-succinimide (derived from 1300 MW PIBSA and heavy polyamine) dispersant, 0.5 wt. % molybdenum succinimide complex dispersant/wear inhibitor, 10 ppm silicone based foam inhibitor, 5.75 wt. % viscosity index improver, 0.3 wt. % pour point depressant, 0.75 wt. % viscosity index improver, and 1.89 wt. % zinc dihydrocarbyl dithiophosphate in 76.17 wt. % base oil consisting of 24.5% Group II base oil having a kinematic viscosity (kv) at 100° C. of 4.7 to 4.9 cSt and 75.5% Group II base oil having a kv at 100° C. of 7.8 to 7.9 cSt.

Testing

Mini-Traction Machine Evaluation

The lubricating oil composition of Example 1 and the lubricating oil compositions of Comparative Examples A-C were evaluated using a PCS Instruments Ltd., London UK, Mini-Traction Machine (MTM) bench test. The PCS MTM instrument was modified so that a ¼-in. diameter Falex 52100 steel test ball (with special holder) was substituted for the pin holder that came with the instrument (see, e.g., Yamaguchi, E. S., "Friction and Wear Measurements Using a Modified MTM Tribometer," IP.com Journal 7, Vol. 2, 9, pp 57-58 (August 2002), No. IPCOM000009117D; and Yamaguchi, E. S., "Soot Wear in Diesel Engines", Journal of Engineering Tribology, Proceedings of the Institution of Mechanical Engineers Part J, Vol. 220, No. J5, pp. 463-469 (2006)). The instrument was used in the pin-on-disk mode and run under sliding conditions. It is achieved by fixing the ball rigidly in the special holder, such that the ball stays still while the disk slides under it. The conditions are shown in Table 1.

TABLE 1

| Test Conditions for MTM | | |
|---|---|---|
| Load | | 14 N |
| Initial Contact Pressure | | 1.53 GPa |
| Temperature | | 116° C. |
| Tribocouple | | 52100/52100 |
| Speed | mm/Sec. | Min. |
| | 3800 | 10 |
| | 2000 | 10 |
| | 1000 | 10 |
| | 100 | 10 |
| | 20 | 10 |
| | 10 | 10 |
| | 5 | 10 |
| Length of Timer | | 70 Min. Test |
| Diesel Engine Soot | | 9% |

Engine soot obtained from the overhead recovery system of an engine testing facility was used for this test. Mineral oil was added to the soot before it was shipped. Therefore, the soot has to be washed prior to the test. It was made into a thin slurry with pentane. The slurry was stirred for a few minutes before it was filtered through a Whatman Number 2 filter paper over a Buchner funnel. The precipitate was made into a thin slurry again and filtered through a Whatman Number 2 filter paper again. The precipitate was then dried in a vacuum oven at 20 inch vacuum and 90° C. for more than 16 hours. The dried soot was then sieved through a 50 mesh (300 μm maximum) before use. The objective of this operation was to remove the oil and other impurities so that reproducible particles are made and they would give rise to abrasive wear as seen in modern exhaust gas recirculation (EGR) engines.

To prepare the test specimens, the anti-corrosion coating of the PCS Instruments 52100 smooth (0.02 micron $R_a$), steel discs was removed using heptane, hexane, and isooctane. Then, the discs were wiped clean with a soft tissue and submersed in a beaker of the cleaning solvent until the film on the disc track had been removed, and the track of the disc appeared shiny. The discs and test balls were placed in individual containers and submerged in Chevron 450 thinner. Lastly, the test specimens were ultrasonically cleaned by placing them in a sonicator for 30 minutes.

The results of this evaluation are set forth in FIG. 1, which show the wear scar diameter (WSD) and standard deviation (STD) of the lubricating oil compositions of Example 1 and Comparative Examples A-C. As the data show, the lubricating oil composition of Comparative Example B treated with a zinc dihydrocarbyl dithiophosphate provided a significantly lower MTM wear result as compared to the lubricating oil composition of Comparative Example A containing no zinc dihydrocarbyl dithiophosphate. This result was expected as zinc dihydrocarbyl dithiophosphate is a known antiwear agent. However, the lubricating oil composition of Example 1 treated with a tetra-functional hydrolyzable silane and containing no zinc dihydrocarbyl dithiophosphate provided an unexpectedly improved MTM wear result as compared to the same lubricating oil composition of Comparative Example B treated with a zinc dihydrocarbyl dithiophosphate and containing no tetra-functional hydrolyzable silane. This is unexpected as each of the lubricating oil compositions of Example 1 and Comparative Examples A and B contained a carboxylate detergent which is believed to be capable of providing wear problems. Finally, the MTM wear result of the lubricating oil composition of Example 1 is as low as the lubricating oil composition of Comparative Example C which is a standard lubricant containing a relatively high amount of zinc dihydrocarbyl dithiophosphate and no tetra-functional hydrolyzable silane.

COMPARATIVE EXAMPLE D

A lubricating oil composition was formed containing 65 wt. % Chevron 100N and 35 wt. % Chevron 220N base oils.

COMPARATIVE EXAMPLE E

A baseline formulation was formed containing 3 wt. % succinimide dispersant, 5 wt. % ethylene carbonate post treated bis-succinimide prepared from a 2300 average molecular weight polyisobutylene succinic anhydride with a heavy polyamine, 0.68% low overbased calcium sulfonate, 4.65% carboxylate detergent, 0.5 wt. % diphenylamine anti-oxidant, 0.5 wt. % hindered phenol anti-oxidant and 10.85 wt. % viscosity improver in 74.7 wt. % of Chevron base oil consisting of 65 wt. % Chevron 100N and 35 wt. % Chevron 220N base oils.

COMPARATIVE EXAMPLE F

A baseline lubricating oil formulation was formed containing the same additives, base oil and treat rate as in Comparative Example E. To the baseline lubricating oil formulation was added 1.5 wt. % tetraethoxy silane and 0.69 wt. % zinc dihydrocarbyl dithiophosphate based on the phosphorus content.

COMPARATIVE EXAMPLE G

To the lubricating oil composition of Comparative Example D was added 0.69 wt. % zinc dihydrocarbyl dithiophosphate based on the phosphorus content.

EXAMPLE 2

A baseline lubricating oil formulation was formed containing the same additives, base oil and treat rate as in Comparative Example E. To the baseline lubricating oil formulation was added 0.86 wt. % tetraethoxy silane and 2 wt. % sodium borate dispersion.

EXAMPLE 3

A baseline lubricating oil formulation was formed containing the same additives, base oil and treat rate as in Comparative Example E. A tetraethoxy silane was formulated into this baseline lubricating oil formulation at 1.5 wt. %.

Testing

Friction and Wear Test

The lubricating oil compositions of Examples 2 and 3 and the lubricating oil compositions of Comparative Examples A, C and D-G were evaluated for friction and wear properties as described in Zhang et al., Study of interaction of EP and AW additives with dispersants using XANES, Tribo. Lett. 18, pp. 43-51 (2005). The tests were carried out using an AISI 52100 steel pin (ϕ6.2 mm×11 mm, HRC 60-64) driven by a motor to reciprocate over a steel disc (ϕ19 mm×4 mm, HRC 60-64, polished to a mirror finish using 3 μm diamond paste) in a pin-on-disc configuration. Before commencing the friction and wear test, about 30 mL of the lubricating oil composition was introduced into the steel disc holder of the Plint machine. The sliding was carried out at a frequency of 25 Hz, stroke of 7 mm, load of 220 N, and a temperature of 100° C., for a duration of 1 hour. The friction coefficient was automatically recorded using a sensor connected to an IBM-PC. At the end of each sliding test, both the upper steel pin and lower steel disc were ultrasonically cleaned in hexane for about 5 minutes and allowed to dry in air. The wear scar widths of the cleaned upper steel pins were measured using a Nikon digital camera. Three repeat sliding wear tests were conducted for each lubricating oil composition, and the averaged wear scar widths of the three tests, with a relative error of ±5%, were recorded.

Figure 2:
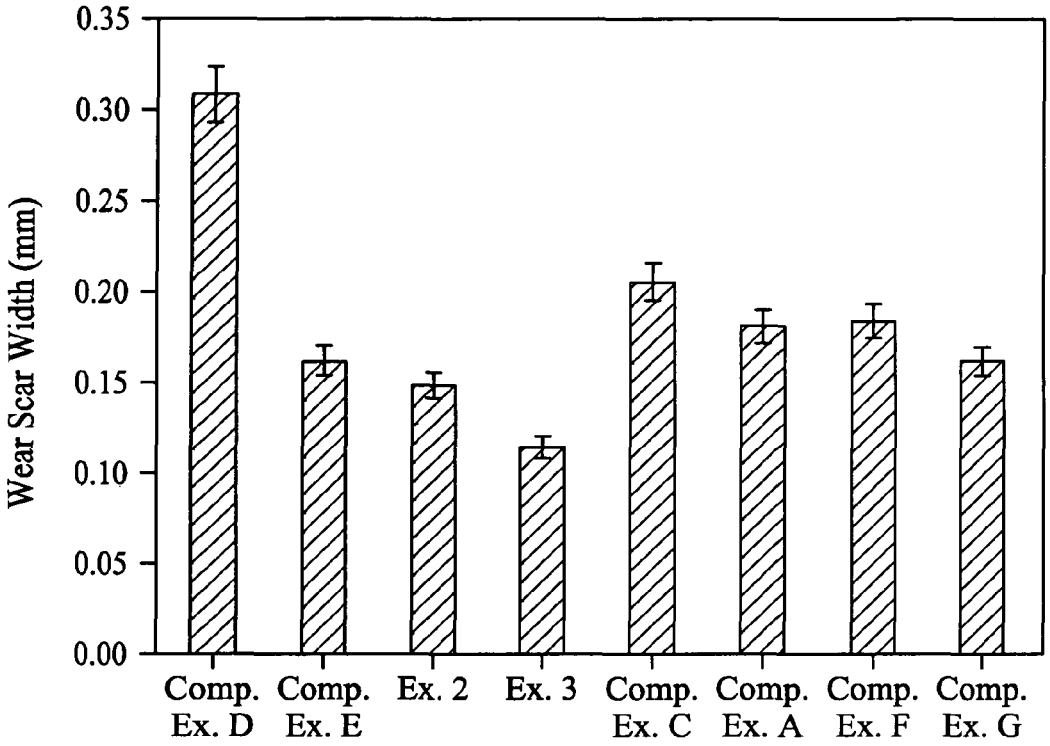
FIG. 2 is a bar graph comparing the wear performance of the lubricating oil compositions of Examples 2 and 3 versus the lubricating oil compositions of Comparative Examples A, C and D-G.

The results of these tests are shown in FIG. 2, which show the WSDs and STDs of the lubricating oil compositions of Examples 2 and 3 and Comparative Examples A, C and D-G. As the data show, the lubricating oil compositions of Examples 2 and 3 provided a lower wear scar width as compared to the lubricating oil compositions of Comparative Examples A, C and D-G. For example, the lubricating oil composition of Example 3 containing 1.5 wt. % tetraethoxy silane and no zinc dihydrocarbyl dithiophosphate provided a significantly lower wear scar than the lubricating oil composition of Comparative Example F containing 1.5 wt. % tetraethoxy silane and 0.69 wt. % zinc dihydrocarbyl dithiophosphate.

It will be understood that various modifications may be made to the embodiments disclosed herein. Therefore the above description should not be construed as limiting, but merely as exemplifications of preferred embodiments. For example, the functions described above and implemented as the best mode for operating the present invention are for illustration purposes only. Other arrangements and methods may be implemented by those skilled in the art without departing from the scope and spirit of this invention. Moreover, those skilled in the art will envision other modifications within the scope and spirit of the claims appended hereto.

What is claimed is:

1. A lubricating oil composition comprising (a) a major amount of an oil of lubricating viscosity selected from the group consisting of Group I, II, III and IV basestocks, and mixtures thereof, and (b) an oil-soluble tetra-functional hydrolyzable silane compound of formula I or a hydrolysis product thereof:

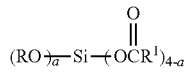

(I)

wherein a is an integer from 1 to 4 and each R is independently a $C_1$ to $C_6$ alkoxy group, $C_6$ to $C_{20}$ aryloxy group, $C_6$ to $C_{20}$ alkylaryloxy group, $C_6$ to $C_{20}$ arylalkyloxy group, $C_6$ to $C_{20}$ cycloalkyloxy group, $C_6$ to $C_{20}$ cycloalkylalkyloxy group, and $C_6$ to $C_{20}$ alkylcycloalkyloxy group, wherein the lubricating oil composition is free of any zinc dialkyl dithiophosphate.

2. The lubricating oil composition of claim 1, wherein each R is independently a straight or branched $C_1$ to $C_6$ alkyl.

3. The lubricating oil composition of claim 1, wherein the oil-soluble tetra-functional hydrolyzable silane compound is selected from the group consisting of tetramethoxysilane, tetraethoxysilane, tetrapropoxysilane, tetraisopropoxysilane, tetrabutoxysilane, tetraisobutoxysilane, tetrakis(methoxyethoxy)silane, tetrakis(methoxypropoxy)silane, tetrakis (ethoxyethoxy)silane, tetrakis(methoxyethoxyethoxy)silane, trimethoxyethoxysilane, dimethoxydiethoxysilane, triethoxymethoxysilane and mixtures thereof.

4. The lubricating oil composition of claim 1, wherein the oil-soluble tetra-functional hydrolyzable silane compound is tetraethoxysilane.

5. The lubricating oil composition of claim 1, wherein the oil-soluble tetra-functional hydrolyzable silane compound is present in an amount of about 0.1 to about 5 wt. %, based on the total weight of the composition.

6. The lubricating oil composition of claim 1, further comprising at least one additive selected from the group consisting of metallic detergents, ashless dispersants, friction modifiers, extreme pressure agents, viscosity index improvers and pour point depressants.

7. The lubricating oil composition of claim 1, further comprising a carboxylate detergent.

8. The lubricating oil composition of claim 1, which is substantially free of any phosphorus content.

9. The lubricating oil composition of claim 1, which shows a 15% reduction in wear scar diameter than the corresponding lubricating oil composition in which the oil-soluble tetra-functional hydrolyzable silane compound is replaced with a zinc dialkyl dithiophosphate compound, as measured by using an AISI 52100 steel pin (ϕ6.2 mm×11 mm, HRC 60-64) driven by a motor to reciprocate over a steel disc (ϕ19 mm×4 mm, HRC 60-64, polished to a mirror finish using 3 μm diamond paste) in a pin-on-disc configuration; wherein prior to commencing the measurement, about 30 mL of a lubricating oil composition was introduced into a steel disc holder; and wherein the sliding was carried out at a frequency of 25 Hz, stroke of 7 mm, load of 220 N, and a temperature of 100° C., for a duration of 1 hour.

10. A lubricating oil composition comprising (a) a major amount of an oil of lubricating viscosity selected from the group consisting of Group I, II, III and IV basestocks, and mixtures thereof, and (b) an oil-soluble tetra-functional hydrolyzable silane compound of formula I or a hydrolysis product thereof:

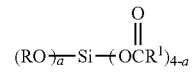

(I)

wherein a is an integer from 1 to 4 and each R is independently a $C_1$ to $C_6$ alkoxy group, $C_6$ to $C_{20}$ aryloxy group, $C_6$ to $C_{20}$ alkylaryloxy group, $C_6$ to $C_{20}$ arylalkyloxy group, $C_6$ to $C_{20}$ cycloalkyloxy group, $C_6$ to $C_{20}$ cycloalkylalkyloxy group, and $C_6$ to $C_{20}$ alkylcycloalkyloxy group, and further wherein the lubricating oil composition is free of any zinc dialkyl dithiophosphate compound and has a wear scar diameter greater than or equal to a corresponding lubricating oil composition in which the oil-soluble tetra-functional hydrolyzable silane compound in the lubricating oil composition is replaced with a zinc dialkyl dithiophosphate compound as measured by using an AISI 52100 steel pin (ϕ6.2 mm×11 mm, HRC 60-64) driven by a motor to reciprocate over a steel disc (ϕ19 mm×4 mm, HRC 60-64, polished to a mirror finish using 3 μm diamond paste) in a pin-on-disc configuration; wherein prior to commencing the measurement, about 30 mL of a lubricating oil composition was introduced into a steel disc holder; and wherein the sliding was carried out at a frequency of 25 Hz, stroke of 7 mm, load of 220 N, and a temperature of 100° C., for a duration of 1 hour.

11. The lubricating oil composition of claim 10, wherein each R is independently a straight or branched chain $C_1$ to $C_6$ alkyl.

12. The lubricating oil composition of claim 10, wherein the oil-soluble tetra-functional hydrolyzable silane compound is tetraethoxysilane.

13. The lubricating oil composition of claim 10, wherein the oil-soluble tetra-functional hydrolyzable silane compound is present in an amount of about 0.1 to about 5 wt. %, based on the total weight of the composition.

14. The lubricating oil composition of claim 10, further comprising at least one additive selected from the group consisting of metallic detergents, ashless dispersants, friction modifiers, extreme pressure agents, viscosity index improvers and pour point depressants.

15. The lubricating oil composition of claim 10, further comprising a carboxylate detergent.

16. The lubricating oil composition of claim 10, which is substantially free of any phosphorus content.

17. The lubricating oil composition of claim 10, which possesses a wear reducing property of at least about 15% greater than the corresponding lubricating oil composition in which the oil-soluble tetra-functional hydrolyzable silane compound is replaced with a zinc dialkyl dithiophosphate compound.

18. A method for reducing wear in an internal combustion engine, the method comprising operating the internal combustion engine with the lubricating oil composition of claim 1.

19. A method for reducing wear in an internal combustion engine, the method comprising operating the internal combustion engine with the lubricating oil composition of claim 8.

20. A method for reducing wear in an internal combustion engine, the method comprising operating the internal combustion engine with the lubricating oil composition of claim 9.

21. A method for reducing wear in an internal combustion engine, the method comprising operating the internal combustion engine with the lubricating oil composition of claim 10.

22. A method for reducing wear in an internal combustion engine, the method comprising operating the internal combustion engine with the lubricating oil composition of claim 17.

23. An internal combustion engine lubricated with the lubricating oil composition of claim 1.

24. An internal combustion engine lubricated with the lubricating oil composition of claim 10.

* * * * *